US005259531A

United States Patent [19]

Bennett

[11] Patent Number: 5,259,531

[45] Date of Patent: Nov. 9, 1993

[54] DEVICE FOR STORING AND DISPENSING PILLS

[75] Inventor: Robert A. Bennett, Easton, Conn.

[73] Assignees: Marybeth Proshan, Princeton, N.J.; Russel O. Stewart, Cos Cob, Conn.

[21] Appl. No.: 12,930

[22] Filed: Feb. 3, 1993

[51] Int. Cl.[5] ..... B65D 83/00

[52] U.S. Cl. ..... 221/233; 221/264; 221/276; 221/154; 222/349; 222/361

[58] Field of Search ..... 221/263, 264, 268, 270, 221/281, 233, 235, 276, 271, 154; 222/361, 362, 349, 351; 206/534.1, 536, 539

[56] References Cited

U.S. PATENT DOCUMENTS

| | | | |
|---|---|---|---|
| 1,880,823 | 10/1932 | Cooper | 222/361 |
| 2,258,983 | 10/1941 | Greaves | 221/271 |
| 2,290,006 | 7/1942 | Troller | 221/271 |
| 2,649,994 | 8/1953 | Lewis et al. | 222/349 |
| 3,115,992 | 12/1963 | Menolasino et al. | 221/276 |
| 5,123,574 | 6/1992 | Poulos | 221/264 |

FOREIGN PATENT DOCUMENTS

| | | | |
|---|---|---|---|
| 979352 | 4/1951 | France | 221/264 |

*Primary Examiner*—H. Grant Skaggs

[57] ABSTRACT

A hollow vertical cylinder has a closed vertical side wall and closed upper and lower ends. The cylinder has an upper region for receiving pills and a lower region from which pills are dispensed. A portion of the upper region is removable. The lower region has a first opening in its lower end which is adapted to pass a pill therethrough and has at least one second opening in its side wall. A thin horizontal partition disposed in the cylinder defines a bottom horizontal surface for the upper region and a top horizontal surface for the lower region and also separates each of the regions from the other. The partition has a third opening adapted to pass a pill therethrough, the third opening being out of alignment with the first opening. A structure disposed in the lower region adjacent the partition has a lever extending outwardly through a second opening in the side wall. The lever, in the absence of any inwardly directed pressure exerted thereon, automatically assumes a first position of maximum extension, and, when inwardly directed pressure is applied thereto, assumes a second position of lesser extension. The structure also has a pill accepting section which is connected to the lever. The section is adapted to receive, transport and discharge a pill. The section, when the lever is in its first position, is placed under the third opening in order to receive any pill delivered through the third opening thereto. The section, when the lever is in its second position, is placed above the first opening in order to deliver any pill previously received by the section to the first opening for discharge therethrough.

12 Claims, 2 Drawing Sheets

FIG. 9
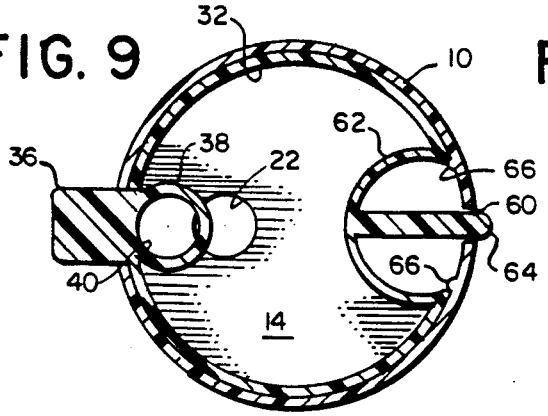
FIG. 10
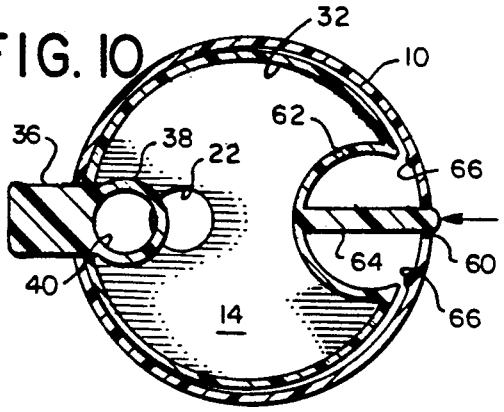
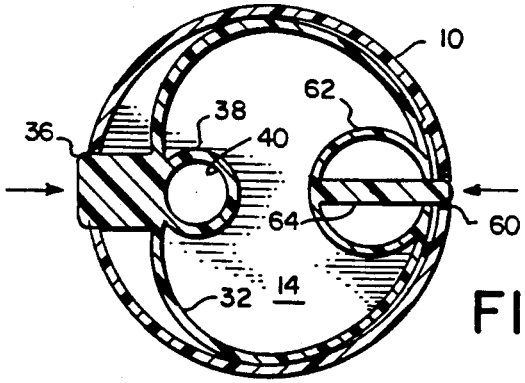
FIG. 11

DEVICE FOR STORING AND DISPENSING PILLS

FIELD OF THE INVENTION

This invention is directed toward containers for storing pills and dispensing pills therefrom.

BACKGROUND OF THE INVENTION

Containers for storing and dispensing pills which are adapted to be carried in a pocket or purse are well known in the art. The present invention is directed toward a new type of container using new techniques for storing pills and dispensing pills one at a time which is also tamper proof and is low in cost.

SUMMARY OF THE INVENTION

Accordingly, it is an object of the present invention to provide a new and improved container for storing and dispensing pills which utilizes new techniques for storing pills and dispensing pills therefrom one at a time.

Another object is to provide a new and improved container of the character indicated which is low in cost because it does not use any cotton filler, top or top liner or tamper wrap.

Yet another object is to provide a new and improved container of the character indicated which dispenses individual pills by manually operating one lever.

Still another object is to provide a new and improved container of the character indicated which can be made child proof by employing two spaced levers which must be manually operated together to dispense individual pills.

These and other objects and advantages of this invention will either be explained or will become apparent hereinafter.

In accordance with the principles of this invention, a container for storing and dispensing pills and the like which is adapted to be carried in pocket or purse employs a hollow vertical cylinder having a closed vertical side wall and closed upper and lower ends. The cylinder has an upper region for receiving pills and a lower region from which pills are dispensed. The lower region has a first opening in its lower end which is adapted to pass a pill therethrough and has at least one second opening in its side wall.

A thin horizontal partition is disposed in the cylinder and defines a bottom horizontal surface for the upper region and a top horizontal surface for the lower region by separating each of the regions from the other. The partition has a third opening adapted to pass a pill therethrough. The third opening is out of alignment with the first opening.

Means disposed in the lower region adjacent the partition is provided with a lever which extends outwardly through a second opening in the side wall. The lever, in the absence of any inwardly directed pressure exerted thereon, automatically assumes a first position of maximum extension. The lever, when inwardly directed pressure is applied thereto, assumes a second position of lesser extension.

The means also has a pill accepting section which is connected to the lever. The section is adapted to receive, transport and discharge a pill. The section, when the lever is in its first position, is placed under the third opening in order to receive any pill delivered through the third opening thereto. When the lever is in its second position, the section is placed above the first opening in order to deliver any pill previously received by the section to the first opening for discharge therethrough.

Thus, in use, it is first necessary to fill the upper region with pills to be dispensed. The container is then tapped gently or subjected to similar movements, and one of the pills in the upper region will be moved into engagement with the third opening and will fall therethrough by action of gravity.

The lever is then in its first position so that the pill receiving section is disposed under the third opening and receives the pill which has fallen through the third opening. Since the third opening is out of alignment with the first opening, the pill remains in the section until the user momentarily exerts inwardly directed pressure on the lever to place it in its second position. This action causes the section to be moved out of alignment with the third opening and into a position above and aligned with the first opening, whereby the pill falls by gravity through the first opening and is thus dispensed for use.

In order to make the container childproof, the lower region is modified to have two spaced apart side openings and the means is modified to have two levers, each lever extending through a corresponding one of the side openings. Each lever has a first position of maximum extension and a second position of reduced extension as previously described. The container is so constructed, as will be explained in more detail below, that the pill receiving section will be positioned under the third opening when either one or both levers are in their first positions. A pill will only be dispensed when the section is disposed above and in alignment with the first opening, and the section can only be so disposed when both levers are placed simultaneously in their second positions, thus providing the requisite childproof operation.

The term "pills" as used herein also includes gel caps, caplets and the like.

BRIEF DESCRIPTION OF THE DRAWINGS

FIG. 9 is a horizontal cross sectional view of the embodiment of FIGS. 1–8 as modified to produce a childproof structure.

FIGS. 10 and 11 are views similar to FIG. 9 but illustrating the two simultaneous actions required for dispensing pills in the modified embodiment of FIG. 9.

DETAILED DESCRIPTION OF PREFERRED EMBODIMENTS

Figure 1:
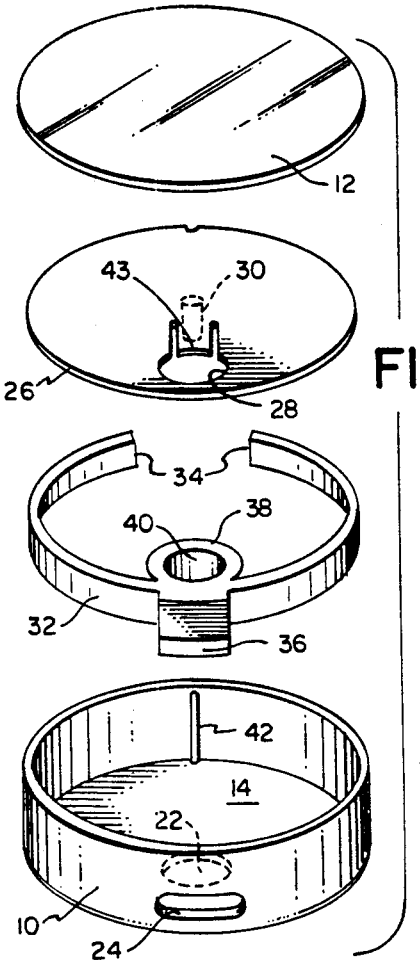
FIG. 1 is an exploded view of one embodiment of the invention.
Figure 2:
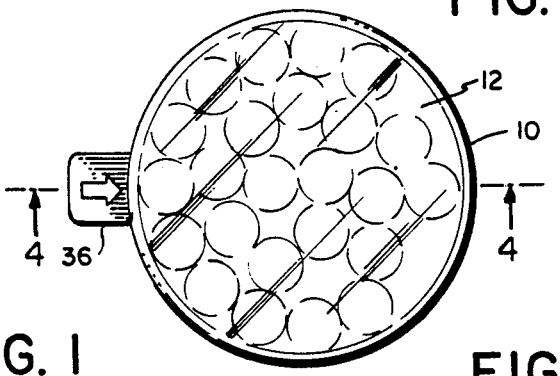
FIG. 2 is a top view of the embodiment of FIG. 1 as assembled.
Figure 3:
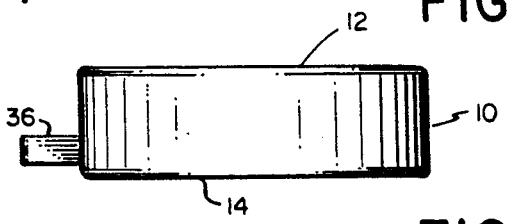
FIG. 3 is a side view of the embodiment of FIG. 2.
Figure 4:
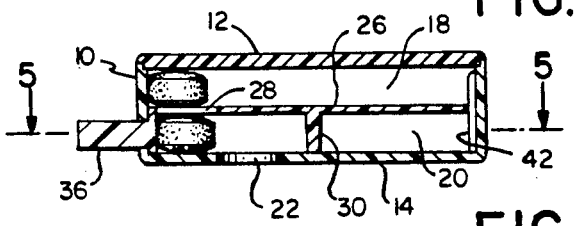
FIG. 4 is a cross sectional view taken along line 4—4 in FIG. 2 showing pills horizontally disposed in position to be dispensed.
Figure 5:
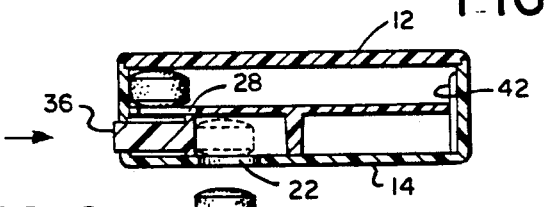
FIG. 5 is a view similar to FIG. 4 but illustrating the pill dispensing action.
Figure 6:
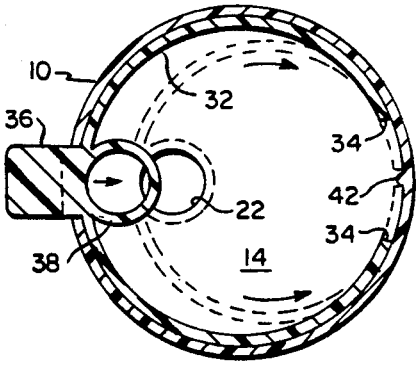
FIG. 6 is a horizontal detail view illustrating a portion of the structure utilized in the pill dispensing action shown in FIG. 5.

FIGS. 1–6 illustrate a container for storing and dispensing pills and the like which is adapted to be carried in pocket or purse. The container typically is formed entirely of plastic. The container includes a hollow vertical right circular cylinder having a closed vertical side wall 10 and closed upper and lower ends 12 and 14. End 14 can be initally removable to permit the insertion of horizontally disposed pills 16 and can be sealed thereafter in place. The cylinder has an upper region 18 for receiving horizontally disposed pills 16 and has a lower region 20 from which pills are dispensed. The lower region has a first opening 22 in its lower end which is adapted to pass a pill therethrough and having at a horizontally elongated second opening 24 in its side wall.

A thin flat horizontal partition 26 is disposed in the cylinder. The partition defines a bottom horizontal surface for the upper region and a top horizontal surface fo the lower region and separates each of the regions from the other. The partition has a third opening 28 adapted to pass a pill therethrough, the third opening being out of alignment with opening 22. A centrally disposed vertical pin 30 extends between the partition and the bottom of the lower region to support the partition in desired position.

Means disposed in the lower region adjacent the partition takes the form of a flexible member 32 having the shape of an almost complete outer circle having an opening 34. Member 32 has an outwardly extending horizontally flat element or lever 36. Member 32 also has a small hollow cylinder 38 which is open at both ends and is disposed inside the outer circle adjacent lever 36. The central opening 40 in cylinder 38 is sized to receive a pill. Member 32 is disposed within the lower region with the lever 36 extending outwardly through opening 24 in the side wall. Lever 24, in the absence of any inwardly directed pressure exerted thereon, automatically assumes a first position of maximum extension, and, when inwardly directed pressure is applied thereto, assumes a second position of lesser extension.

Cylinder 38 defines a pill accepting section which is connected to said lever and is adapted to receive, transport and discharge a pill.

Member 32 functions as a spring. When lever 26 is pressed inwardly, the outer circle is squeezed inwardly, as shown in phantom in FIG. 6 until the opposite ends of opening 34 engage opposite sides of a vertical post 42 disposed on the inner surface of the lower section in a position directly opposite of lever 36. When the pressure on lever 36 is released, the member 32 automatically returns to its original position.

When the lever is in its first position, cylinder 38 is placed under opening 28 in order to receive any pill delivered thereto. When the lever is in its second position, cylinder 38 is placed above opening 22 in order to deliver any pill previously received by the cylinder to opening 22 for discharge therethrough.

Figure 7:
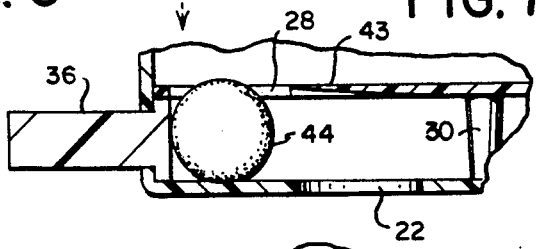
FIGS. 7 and 8 are views illustrating the pill dispensing action when a pill is disposed vertically rather than horizontally.
Figure 8:
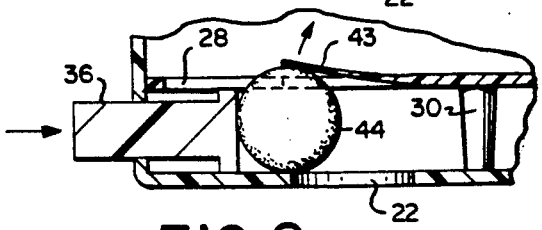

The partition 26 has a flexible pill guiding chute 43 therein disposed adjacent and communicating with opening 28. From time to time, a pill may be shifted in position and disposed vertically. As shown in FIGS. 7 and 8, when a pill is disposed vertically rather than horizontally, and the lever is moved into its second position, the cylinder 38 moves the vertical pill 44 to overlie opening 22. The upper peripheral portion of the pill engages the chute and the chute is pivoted slightly upward. The chute has a spring like action and automatically restores itself to its horizontal position, pushing the pill downwardly through opening 22.

In the modification shown in FIGS. 9–11, the lower region is provided with a second opening 60 in the side wall which is disposed directly opposite to opening 34. The opening 60 is vertically elongated. The opposite ends of opening 34 are connected by an inner loop 62. A second lever 64, vertically flat extends through opening 60 and is secured at one end to the center of loop 62. Lever 26 has a first position of maximum extension at which each of two spaced vertical posts 66 is engaged by a corresponding end of opening 34. Lever 64 has second position of lesser extension at which the loop is pushed inwardly and the opposite ends of opening 34 are moved inwardly out of engagement with the posts.

FIG. 9 shows the structure with both of the levers in their first positions. Cylinder 38 is disposed under opening 28 and no pills can be dispensed. FIG. 10 shows the structure with lever 26 in its first position and lever 64 is in its second position. While the opposite ends of opening 34 have been moved away from the posts, cylinder 38 remains disposed under opening 28 and no pills can be dispensed. Similarly, when lever 64 is in its first position, the opposite ends of opening 34 remain engaged with the posts even if lever 26 is placed in its second position. As a consequence, cylinder 38 will remain disposed under opening 28 and no pills can be dispensed.

However, as shown in FIG. 11, if lever 64 remains in its second position and lever 26 is placed in its second position, loop 22 is deformed into almost a complete circle with the ends of opening 34 engaging the lever 64. Cylinder 38 is then disposed over opening 22 and pills can be dispensed therethrough.

Consequently, the dispenser shown in FIGS. 9–11 can only dispense pills when both levers are pushed inwardly to be placed in their second positions at the same time. Since there are two simultaneous actions required for dispensing, the dispenser is childproof.

The lever 64 can have a horizontal tip and opening 60 can be disposed horizontally rather than vertically to accommodate this horizontal tip.

While the invention has been described with specific reference to preferred embodiments, the protection solicited is to be limited only by the terms of the claims which follow.

What is claimed is:

1. A container for storing and dispensing pills and the like, said container comprising:

a hollow vertical cylinder having integral closed vertical side wall and closed upper and lower ends and sized to be carried in pocket or purse, the cylinder having an integral upper region for receiving pills and an integral lower region from which pills are dispensed, the lower region having a first opening in its lower end which is adapted to pass a pill therethrough and having at least one second opening in its side wall;

a thin horizontal partition disposed in the cylinder and integral therewith, said partition being spaced from top and bottom ends and defining a bottom horizontal surface for the upper region and a top horizontal surface for the lower region and separates each of the regions from the other, said partition having a third opening adapted to pass a pill therethrough, the third opening being out of alignment with the first opening; and means disposed in the lower region adjacent the partition and having a lever extending outwardly through a second opening in the side wall, said lever, which in the absence of any inwardly directed pressure exerted thereon, automatically assumes a first position of maximum extension, said lever, when inwardly directed pressure is applied thereto, assuming a second position of lesser extension, said means also having a flat horizontal pill accepting section which is connected to said lever, said section having a single opening which is adapted to receive, transport and discharge a single pill, said section, when the lever is in its first position, being placed under the third opening in order to receive any pill delivered through the third opening thereto, the section, when the lever is in its second position, being placed above the first opening in order to deliver any pill previously received by the section to the first opening for discharge therethrough.

2. The container of claim 1 wherein the partition has a thin and flexible pill guiding chute disposed therein adjacent and communicating with the third opening.

3. The container of claim 2 wherein said means includes a horizontal member disposed within the cylinder and containing said section, said member defining an incomplete circle.

4. The container of claim 3 wherein the member defines a spring function, the member being compressed against the inner surface of the lower region when the lever is in the second position, the member being automatically released from compression when the lever is in the first position.

5. The container of claim 1 wherein the lower region is provided with two spaced apart openings in the side wall and wherein said means has two levers, each lever extending through a corresponding one of the side wall openings.

6. The container of claim 5 wherein each lever has a first position of maximum extension in the absence of any pressure exerted thereon and has a second position of lesser extension when inwardly directed pressure is applied thereto.

7. The container of claim 6 wherein the section, is placed above the first opening only when both levers are in their second positions, the section being otherwise placed below the third opening.

8. The container of claim 7 wherein said means includes a horizontal member disposed within the cylinder and containing said section, said member defining an incomplete circle, one lever being connected both to the section and the member, the other lever being connected only to the member.

9. The container of claim 5 wherein one of the two openings in the side wall is horizontally elongated while the other of the two openings in the side wall is vertically elongated.

10. The container of claim 9 wherein the lever extending through the one opening is horizontally disposed while the lever extending through the other opening is vertically disposed.

11. The container of claim 1 wherein the upper region is adapted to receive only one layer of pills.

12. The container of claim 1 wherein the upper region is adapted to receive a plurality of layers of pills.

* * * * *